US005792978A

United States Patent [19]

Woodall, Jr. et al.

[11] Patent Number: 5,792,978

[45] Date of Patent: Aug. 11, 1998

[54] BARGE STRIKE EXPLOSIVE CLEARANCE SYSTEM

[75] Inventors: Robert C. Woodall, Jr., Lynn Haven; Felipe A. Garcia, Panama City, both of Fla.

[73] Assignee: The United States of America as represented by the Secretary of the Navy, Washington, D.C.

[21] Appl. No.: 863,238

[22] Filed: May 27, 1997

[51] Int. Cl.[6] ..... F42B 22/42

[52] U.S. Cl. ..... 102/403; 102/293; 89/1.11; 86/50

[58] Field of Search ..... 102/402, 403, 102/293, 701; 89/1.11; 114/26, 270; 86/50

[56] References Cited

U.S. PATENT DOCUMENTS

| | | | |
|---|---|---|---|
| 2,509,205 | 5/1950 | Bisch | 102/403 |
| 3,183,835 | 5/1965 | Bisch | 102/403 |
| 3,741,119 | 6/1973 | Eckels | 102/403 |
| 3,982,486 | 9/1976 | Eckels | 102/403 |
| 4,018,163 | 4/1977 | Brown | 102/403 |
| 4,823,672 | 4/1989 | Eidelman | 102/403 |
| 5,277,117 | 1/1994 | Bender et al. | 102/402 |
| 5,708,230 | 1/1998 | Woodall, Jr. et al. | 102/402 |

*Primary Examiner*—Harold J. Tudor
*Attorney, Agent, or Firm*—Harvey A. Gilbert

[57] ABSTRACT

A barge strike system for clearing an obstacle-filled region of water includes a floating barge having at least one hollow region defined therein. The barge is equipped to move under its own power to the obstacle-filled region at various speeds, including speeds in excess of minimum planing speed. Explosive material is contained in the barge's hollow region (s). A plurality of detonators are coupled to a top surface of the explosive material and are initiated to generate a coalesced planar wave downward through the explosive material.

20 Claims, 2 Drawing Sheets

BARGE STRIKE EXPLOSIVE CLEARANCE SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to underwater mine clearing systems, and more particularly to an underwater mine or obstacle clearance system for the expedient clearing of a safe and navigable path to a beachfront.

BACKGROUND OF THE INVENTION

Amphibious assault generally involves the elimination of mines or other underwater obstacles to provide a navigable path to a beachfront. Presently, small-scale distributed explosive mine/obstacle clearing systems are being evaluated as a means to support amphibious assault. Small-scale systems typically include one-dimensional systems (discontinuous line charges) and two-dimensional systems (detonating cord nets and miniature bomblet arrays).

The small-scale systems require obstacles to be removed or substantially diminished prior to being used in mine clearance operations. Such approaches are limited in scale, speed, and lack the tonnage necessary for simultaneous obstacle and mine clearing in an over the horizon amphibious assault. Small-scale distributed explosive mine clearance systems can also require significant amounts of time involving numerous deployments. Even when properly deployed, the small-scale systems still may not create a safely cleared assault lane of adequate dimension for a landing fleet to safely traverse. Additionally, small-scale systems require the development of lane marking devices to indicate the cleared path through the water. Many of the small-scale mine clearance systems, as well as lane marking initiatives, can only be used safely and effectively once the beachfront area is secured by friendly forces. However, this requires amphibious forces to come into range of direct enemy fire for a period of time.

SUMMARY OF THE INVENTION

Accordingly, it is an object of the present invention to provide a system for the expedient clearing of a path through an obstacle-filled body of water near a beachfront.

Another object of the present invention is to provide a system that eliminates mines and other obstacles along a safe and navigable path to a beachfront in support of an amphibious assault.

Still another object of the present invention is to provide a system that eliminates mines and other obstacles along a navigable path to a beachfront without requiring personnel at or near the beachfront to deploy same.

Other objects and advantages of the present invention will become more obvious hereinafter in the specification and drawings.

In accordance with the present invention, a system for clearing an obstacle-filled region of water is provided. A floating barge has at least one hollow region defined therein. Propulsors are mounted on the barge for supplying a motive force necessary to move the barge to the obstacle-filled region in an expedient fashion as dictated by operational requirements. Explosive material is contained in at least one of the barge's hollow regions. A plurality of detonators are coupled to a top surface of the explosive material and are initiated to generate a coalesced planar wave downward through the explosive material.

DETAILED DESCRIPTION OF THE INVENTION

Figure 1:
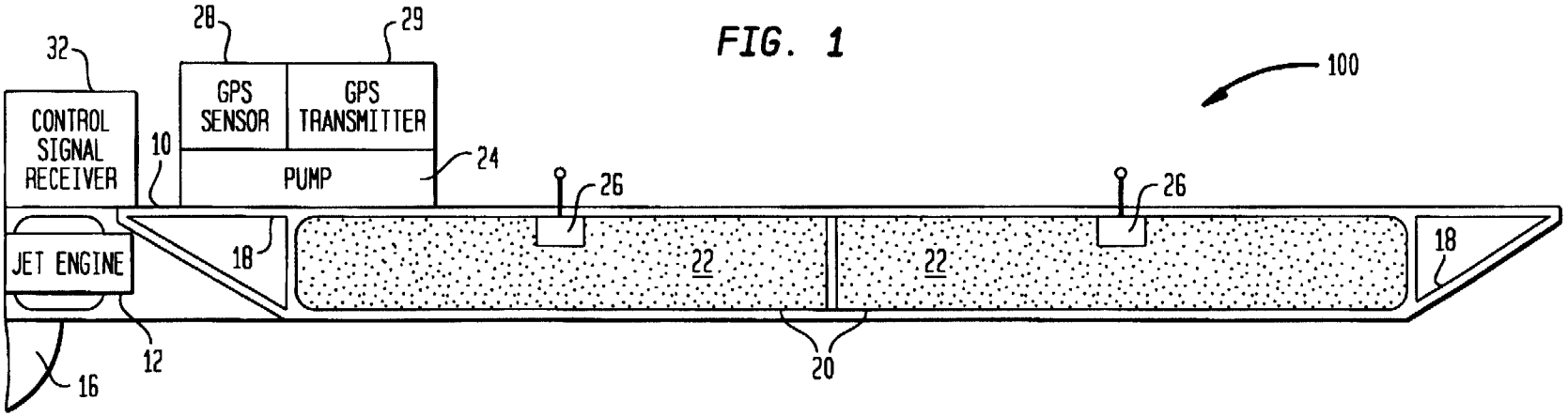
FIG. 1 is a side sectional/schematic view of an embodiment of a barge strike explosive mine and obstacle clearance system according to the present invention.
Figure 2:
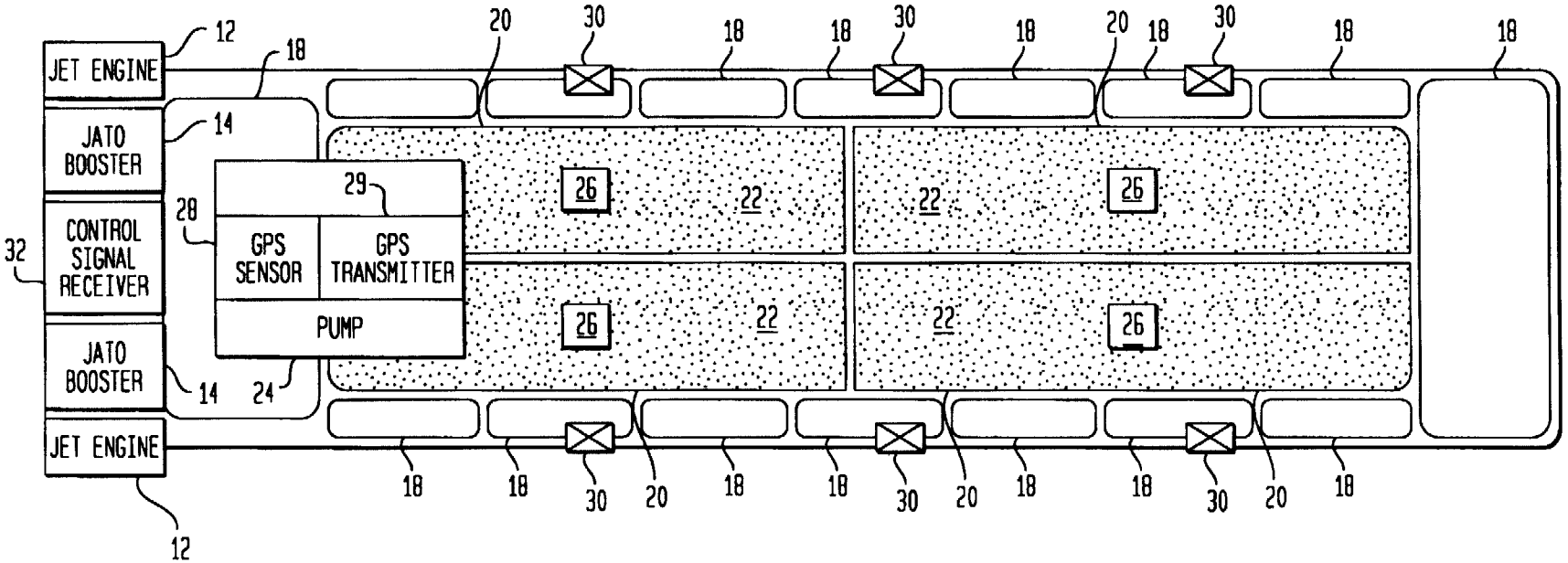
FIG. 2 is a top sectional/schematic view of the barge strike explosive clearance system.

Referring now to the drawings, and more particularly to FIGS. 1 and 2, an embodiment of the barge strike explosive mine and obstacle clearance system according to the present invention is shown and referenced generally by numeral 100. System 100 is designed to be deployed from a remote location and is constructed using a floating barge 10 such as the U.S. Navy's ship-waste off-loading barge. However, it is to be understood that any existing or specially designed barge can be used. The barge can present a low profile thereby improving its usefulness for covert operations. The barge can be constructed as a multi-hull vessel so that it can survive collisions with obstacles while traveling at cruising speed to its destination. System 100 can be designed for speed and/or maneuverability as the application requires. This would typically be the case for an amphibious assault. By way of example, the remainder of the description will assume that system 100 is to be used in an amphibious assault.

Barge 10 is provided with a high-power propulsion system that allows barge 10 to plane across the water for fast deployment and ease of maneuverability. For example, jet propulsors or engines 12 (e.g., surplus or moth-balled turbo fan or other jet engines) could be mounted at the aft end of barge 10. To assist in initially moving barge 10 to its planing speed, jet-assisted take off (JATO) rockets 14 can be provided to power barge 10 to or beyond its hump speed, i.e., the speed at which barge 10 begins to climb out of the wave trough that it creates. In most instances, a steering mechanism is provided on barge 10 which is represented generally in FIG. 1 by rudder 16.

As mentioned above, barge 10 defines a plurality of hollow regions. In the present invention, some of the hollow regions are filled with explosive material while others remain as air-filled voids for floating barge 10, for protecting the contents of barge 10 from impact damage, and for use in scuttling barge 10 as will be explained further below. For example, regions 18 about the periphery of barge 10 are air-filled while interior compartments or regions 20 (four are shown in the illustrated embodiment) are loaded with explosive material 22.

Explosive material 22 must satisfy a number of criteria in order to be useful in system 100. For proper void-free loading within each of regions 20, explosive material 22 must easily conform to the geometry of each region 20. Further, since the possibility exists that explosive material 22 will get wet during loading of and transportation in barge 10, explosive material 22 must be capable of detonation when wet. Typically, explosive material 22 will experience a rough "ride" as barge 10 is propelled through the water. This can be due to rough seas, the presence of floating debris, possible (unwanted) collision with other vessels, etc. Thus, explosive material 22 should be insensitive to shocks experienced by the whole of barge 10. Explosive material 22 should be of the insensitive type that must be detonated and preferably in accordance with a specified manner not to be encountered in normal handling and transport. Finally, since it is desirable to maximize the elimination of mines or obstacles at detonation time, explosive material 22 should be capable of presenting a relatively long-duration pressure wave of sufficient pressure level to achieve the complete elimination of mines and obstacles. Taking the above into account, suitable explosive materials for the present invention are classified and identified generally as blasting agent slurries. Examples of such blasting agent slurries that exhibit few storage and handling problems include ammonium nitrate fuel oil (ANFO), aluminized ANFO (ANFO-AL), or other commercially available blasting agent slurries that may be of proprietary enhanced composition but meet the above-described criteria.

Explosive material 22 is typically pumped into each hollow region 22 using a pump onboard a mother ship (not shown) or pump 24 which can be mounted onto barge 10 as part of system 100. Detonators 26 are then placed on top of explosive material 22 in each region 20. Although only one detonator 26 is shown associated with explosive material 22 in each region 20, it is to be understood that any number of detonators 26 could be used in each of regions 20. The positioning of each such detonator 26 will be discussed further below.

Figure 3:
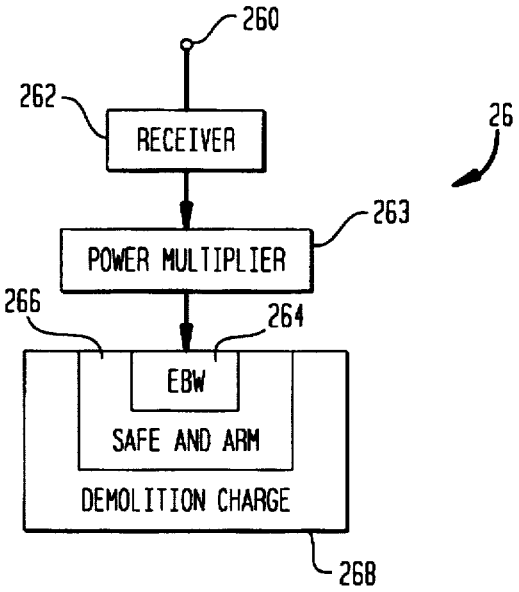
FIG. 3 is a schematic view of an embodiment of a detonator system used in the present invention.

Referring additionally to FIG. 3, an example of one such detonator 26 will be explained. Since each detonator 26 is to be controlled from a remote location (e.g., a mother ship), detonator 26 will typically have an antenna 260 for receiving a detonation signal (e.g., an RF signal, an acoustic signal, etc.), a receiver 262 and power multiplier 263 which receives and boosts, respectively, the power of the received signal. For purposes of the present invention, using fast detonators is critical in order to properly direct the direction of the overall pressure wave produced by system 100. A quick detonation train can be achieved, for example, by using an exploding bridgewire (EBW) 264 receiving a high-power signal from power multiplier 263. Typically, EBW 264 is held within a safe and arm mechanism 266 in order to keep EBW 264 out of line with a small demolition charge 268 which transmits an initial shockwave into explosive material 22. A suitable receiver 262 is available from BDL Systems Limited, Dorset, England; a suitable power multiplier 263 and EBW 264 are available from Reynolds Industries Systems, Incorporated, San Ramon, Calif.; a suitable safe and arm device is the U.S. Navy's Mk-9 safe and arm device; and suitable demolition charges include the U.S. Navy's C-4 or W-9 demolition charges.

Referring again to FIGS. 1 and 2, system 100 can include additional features depending on the particular mission criteria. For example, own-vessel location could be provided by utilizing the global positioning system (GPS). A GPS sensor 28 capable of receiving GPS signals from GPS satellites (not shown) is coupled to a transmitter 29 for transmitting the location of barge 10 using such GPS signals. In this way the exact location of system 100 can be known at detonation. Barge 10 could also be equipped with scuttle valves 30 (or charges) in some or all of air-filled regions 18 so that barge 10 could be sunk prior to detonation of explosive material 22 if it was necessary to bring barge 10 closer to the target. In such an instance, the antenna associated with each detonator could be implemented by an acoustic hydrophone sensitive to a particular underwater acoustic transmission for initiating detonation.

Barge 10 could be deployed on a pre-designed course or could be controlled from a remote location. In the illustrated example, system 100 is shown with a vehicle control signal receiver 32 which is coupled to jet propulsors 12, JATO rockets 14 and steering mechanism 16. A remotely issued command/control signal is transmitted to receiver 32 which activates jet propulsors 12 and, if present, JATO rockets 14 and steering mechanism 16. JATO rockets 14 are used initially to quickly take barge 10 to planing speed so that such planing is easily maintained by jet propulsors 12 and steered by steering mechanism 16.

Figure 4:
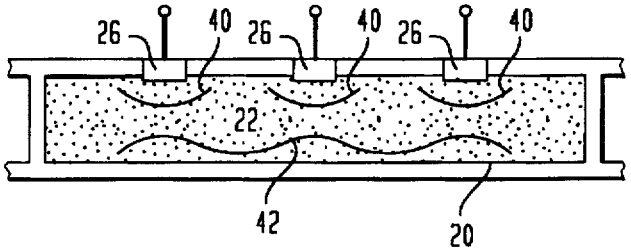
FIG. 4 is a schematic view showing the coalescing progression of multiple shock waves during detonation to form a downwardly directed planar wave in the present invention.

The number and placement of detonators 26 is such that, at detonation, a downwardly-directed planar pressure wave results. This is best illustrated in FIG. 4 where detonation of explosive material 22 in one region 20 will be explained. At detonation, each detonator 26 is commanded to detonate its respective demolition charge. If each detonator 26 is identically configured, the initial pressure waves 40 from detonation of explosive material 22 radiating downward into explosive material 22 will be nearly identical. Further, if detonators 26 lie in the same plane as shown and if each detonator 26 is detonated simultaneously (or "nearly simultaneously" which is defined herein as being within a few milliseconds), initial pressure waves 40 will coalesce to form a downwardly-directed planar wave 42 moving down through explosive material 22.

Detonators 26 should be arranged in symmetrical units in region 20. This can be accomplished using a repeating triangle unit (i.e., groups of three detonators arranged in a triangle) or a repeating square unit (i.e., groups of four detonators arranged in a square). The triangular arrangement is more advantageous because it provides symmetry with the fewest number of detonators, i.e., fewer shock waves are required to interact to generate the plane wave. The configuration of region 20 will have an impact only at the boundaries thereof where the repeating geometric arrangement of detonators intersects with the walls of the barge that define region 20.

Figure 5:
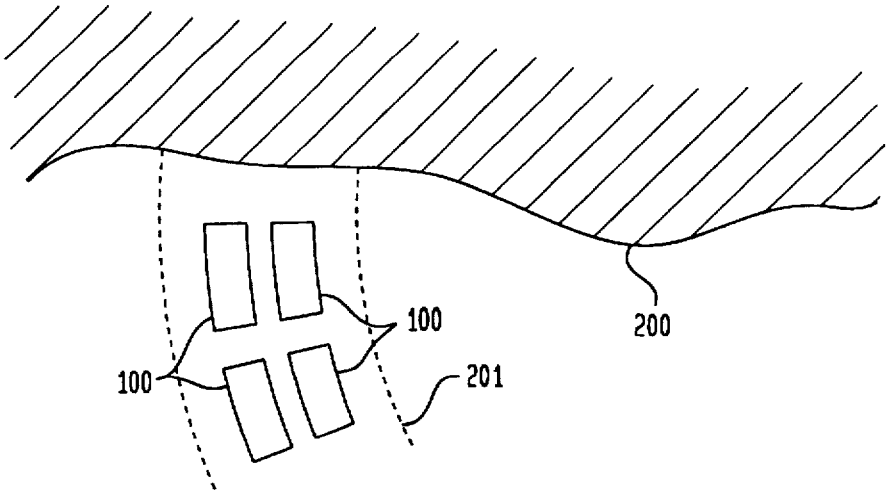
FIG. 5 depicts an operational scenario in which a navigable path to a beachfront is to be cleared using a plurality of barges configured according to the present invention.

An operational scenario using the present invention will now be explained for clearing a navigable path to a beachfront. Referring now to FIG. 5, a plurality of barges 10 are deployed to define a path 201 to a beachfront 200. Each of the barges is configured as system 100 as described above and is positioned at its predetermined path point which is verified by means of the GPS sensor/transmitter mounted (not shown in FIG. 5 for sake of clarity) on each barge 10. Once in position, each of barges 10 is detonated to produce its own downwardly directed planar wave. Note that all barges could be detonated substantially simultaneously to create one large downwardly directed planar wave. Alternatively, each of the barges could be detonated individually. The GPS positions just prior to detonation define path 201 to beachfront 200. Detonation of each barge can be at the surface or under the surface of the water.

The advantages of the present invention are numerous. Both mines and obstacles are simultaneously eliminated with one system and without requiring local personnel in order to clear a navigable path to a beachfront. The high speed (planing) system can be built from existing components and therefor represents a cost-effective solution to the development of a mine and obstacle clearance system.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A system for clearing an obstacle-filled region of water, comprising:

a barge for floating on water and having at least one hollow region defined therein;

propulsion means mounted on said barge for supplying a motive force necessary to move said barge to said obstacle-filled region;

explosive material in said at least one hollow region; and a plurality of detonators coupled to a top surface of said explosive material, said plurality of detonators initiated to generate a coalesced planar wave downward through said explosive material.

2. A system as in claim 1 further comprising a receiver mounted on said barge and coupled to said propulsion means for receiving control signals that control operation of said propulsion means.

3. A system as in claim 2 further comprising steering means mounted on said barge and coupled to said receiver wherein said control signals further control operation of said steering means to steer said barge.

4. A system as in claim 1 wherein said explosive material is conformable to said at least one hollow region.

5. A system as in claim 1 wherein said explosive material is detonateable in water.

6. A system as in claim 1 further comprising:

global positioning system (GPS) sensors mounted on said barge for receiving GPS signals; and a transmitter coupled to said GPS sensors for transmitting a location of said barge based on said GPS signals.

7. A system as in claim 1 further comprising a plurality of signal receivers, each of said plurality of signal receivers coupled to a corresponding one of said plurality of detonators for receiving a detonation control signal from a remote location.

8. A system as in claim 1 further comprising means for submerging said barge prior to generation of said coalesced planar wave.

9. A system for clearing an obstacle-filled region of water, comprising:

a barge for floating on water and having a plurality of hollow regions defined therein;

jet propulsors mounted on said barge for supplying a motive force for said barge;

steering means mounted on said barge for steering said barge to said obstacle-filled region when said motive force is supplied thereto;

a receiver mounted on said barge and coupled to said jet propulsors and said steering means for receiving control signals that control operation of said jet propulsors and operation of said steering means;

a slurried blasting agent loaded into at least a portion of said plurality of hollow regions; and detonation means coupled to a top surface of said slurried blasting agent in each said portion of said plurality of hollow regions for substantially simultaneously detonating said slurried blasting agent in each said portion of said plurality of hollow regions to generate a downwardly directed planar wave through said slurried blasting agent.

10. A system as in claim 9 further comprising jet-assisted take-off rockets mounted on said barge for increasing said motive force.

11. A system as in claim 9 wherein said slurried blasting agent is detonateable in water.

12. A system as in claim 9 further comprising:

global positioning system (GPS) sensors mounted on said barge for receiving GPS signals; and a transmitter coupled to said GPS sensors for transmitting a location of said barge based on said GPS signals.

13. A system as in claim 9 wherein said detonation means includes signal receiving means for receiving a detonation control signal from a remote location.

14. A system as in claim 9 further comprising means for submerging said barge prior to generation of said planar wave.

15. A system for clearing a path through an obstacle-filled region of water, comprising:

a plurality of barges, each of said plurality of barges for floating on water and having a plurality of hollow regions defined therein;

jet propulsors mounted on each of said plurality of barges for supplying a motive force thereto;

steering means mounted on each of said plurality of barges, wherein said jet propulsors and said steering means are operated to arrange said plurality of barges along a path;

a receiver mounted on each of said plurality of barges and coupled to said jet propulsors and said steering means associated with each of said plurality of barges for receiving control signals that control operation of said jet propulsors and operation of said steering means;

a slurried blasting agent loaded into at least a portion of said plurality of hollow regions of each of said plurality of barges; and detonation means coupled to a top surface of said slurried blasting agent in each said portion of said plurality of hollow regions of each of said plurality of barges for substantially simultaneously detonating said slurried blasting agent in each said portion of said plurality of hollow regions associated with each of said plurality of barges to generate a downwardly directed planar wave through said slurried blasting agent in each of said plurality of barges.

16. A system as in claim 15 further comprising jet-assisted take-off rockets mounted on each of said plurality of barges for increasing said motive force.

17. A system as in claim 15 wherein said slurried blasting agent is detonateable in water.

18. A system as in claim 15 further comprising:

global positioning system (GPS) sensors mounted on each of said plurality of barges for receiving GPS signals; and a transmitter coupled to each of said GPS sensors for transmitting a location of an associated one of said plurality of barges based on said GPS signals.

19. A system as in claim 15 wherein said detonation means includes signal receiving means for receiving a detonation control signal from a remote location.

20. A system as in claim 15 wherein at least one of said plurality of barges further comprises means for submerging said at least one of said plurality of barges prior to generation of said planar wave.

* * * * *